United States Patent [19]

Corrie

[11] 3,933,080

[45] Jan. 20, 1976

[54] PNEUMATIC ACTUATORS

[75] Inventor: Nicholas John Byrom Corrie, Camberley, England

[73] Assignee: Martonair Limited, Middlesex, England

[22] Filed: Sept. 7, 1972

[21] Appl. No.: 286,862

[30] Foreign Application Priority Data

Sept. 14, 1971 United Kingdom ..... 42763/71

[52] U.S. Cl. ..... 91/394; 91/26; 91/405

[51] Int. Cl.[2] ..... F15B 15/22

[58] Field of Search ..... 91/435, 364, 388, 394, 91/404, 405, 408, 409, 452, 24, 25, 26; 92/8, 92/10, 85, 143; 188/280, 284

[56] References Cited

UNITED STATES PATENTS

| | | | |
|---|---|---|---|
| 752,491 | 2/1904 | Warren | 91/435 X |
| 1,609,472 | 12/1926 | Heil et al. | 91/26 X |
| 2,051,837 | 8/1936 | Fischel | 91/435 X |
| 2,637,301 | 5/1953 | Burdick | 91/364 X |
| 2,681,044 | 6/1954 | Eggenberger | 91/364 X |
| 2,759,458 | 8/1956 | Robinson | 92/8 |
| 3,009,447 | 11/1961 | Lloyd | 91/364 |
| 3,136,220 | 6/1964 | Kamm | 91/451 X |
| 3,238,850 | 3/1966 | Desmarchelier | 91/394 |
| 3,386,343 | 6/1968 | Gray | 91/364 |
| 3,412,645 | 11/1968 | Kirk | 91/26 |
| 3,419,114 | 12/1968 | Rumsey | 188/280 |
| 3,540,471 | 11/1970 | Churchill | 137/513.3 |

FOREIGN PATENTS OR APPLICATIONS

| | | | |
|---|---|---|---|
| 27,926 | 2/1966 | Japan | 91/26 |

*Primary Examiner*—Irwin C. Cohen
*Attorney, Agent, or Firm*—Gifford, Chandler & Sheridan

[57] ABSTRACT

A piston-in-cylinder type pneumatic actuator is provided with an automatic cushioning facility to prevent the piston from returning to its fully retracted position at velocities exceeding a predetermined maximum velocity. Integrally-housed in the actuator is a velocity transducer arranged to sense the pressure in a cylinder working volume, which pressure is related to the piston velocity and is used to control the operation of an exhaust valve operable to vary the rate of flow of gas from the cylinder thereby to vary the rate of return of the piston.

3 Claims, 7 Drawing Figures

PNEUMATIC ACTUATORS

BACKGROUND OF THE INVENTION

This invention relates to a pneumatic actuator and is particularly, but not exclusively, concerned with the sensing and subsequent control of the velocity of an output element of a pneumatic actuator.

SUMMARY OF THE PRESENT INVENTION

In order to control the velocity of the actuator output element, typically a piston, it is necessary to employ some form of velocity transducer which is arranged to produce an analogue output of the velocity in question which is then fed as an input to a suitable controller arranged to control the velocity.

A suitable form of velocity transducer is one which operates pneumatically and which essentially comprises a piston-in-cylinder device with an orifice in the cylinder of such size that the pressure developed within the cylinder is a predetermined function of the piston velocity.

It is an object of the present invention to achieve an arrangement for providing automatic control, for example cushioning, of a pneumatic actuator whereby a movable output element such as a piston, of a pneumatic actuator is limited to a predetermined velocity at or near an extremity of its movement in order to prevent an unacceptably high deceleration at said extremity.

According to the present invention, a pneumatic actuator has an output element which is coupled to a piston of a piston-in-cylinder type of velocity transducer so arranged that the pressure developed in a cylinder working volume by said transducer piston is a function of the velocity of said output element of said pneumatic actuator, said pressure being fed as an input to controller means arranged to control a supply of air to or from said pneumatic actuator whereby to adjust the velocity of said output member to within a predetermined range.

In embodiments of the invention where said pneumatic actuator is of the piston-in-cylinder type, and the piston thereof is directly coupled to the piston of said velocity transducer, said pneumatic velocity transducer may form an integral part of said pneumatic actuator, a common operating piston and cylinder being employed.

Preferably, in order to achieve automatic cushioning of the velocity of a piston of a pneumatic actuator, the common operating piston and cylinder are shaped to define two separate working volumes, to one of which is connected an exhaust port with exhaust valve means whereby said one volume is operable as a cushion volume to limit the piston velocity according to the setting of said exhaust valve means, and the other of which working volumes is provided with an outlet orifice controllable by pressure relief valve means whereby said outlet orifice is of fixed effective cross-sectional size only at pressures below a pressure corresponding to a predetermined maximum piston velocity, which pressures are thereby a predetermined function of piston velocity; said exhaust valve means being operable in response to pressures in said other working volume to close said exhaust port when the piston velocity is above said predetermined maximum velocity to render the cushioning action of said one volume operative and to open said exhaust port at piston velocities at or below said predetermined maximum to at least partially reduce cushioning action of said one working volume.

Desirably, the dimensions of said exhaust port are such as to allow, in the open condition of said exhaust valve, a predetermined rate of expulsion of air from said one working volume associated with a piston velocity at or below said predetermined maximum piston velocity.

Conveniently, said cylinder includes a region of reduced cross-section and said piston includes a boss locatable within said region of reduced cross-section at or near one extremity of its range of possible movement, said other working volume being defined between said boss and the cylinder walls in said region of reduced cross-section and said one working volume being defined between a shoulder of the piston beyond said boss, the walls of said boss and the walls of the cylinder beyond said region of reduced cross-section.

In some embodiments said exhaust valve means and said pressure relief valve means are combined in a single valve operable to open and close the exhaust port and outlet orifice in accordance with the pressure conditions in said working volumes. In one such embodiment said single valve comprises a piston-in-cylinder type valve, the housing being defined by a casing integral with the cylinder of the actuator and connected directly to said exhaust port and said outlet orifice, the single valve being operable between a first condition in which discharge through said outlet orifice is permitted and also through said exhaust port and a second condition in which said exhaust port is obstructed, preventing the escape of gas from the cushion volume, whilst said outlet orifice remains unobstructed. As a further modification to inhibit any tendency for over-cushioning to occur there is preferably provided an additional cushion relief valve between said exhaust port and said exhaust valve means operable to effectively close the exhaust port when the pressure in said cushion volume is below a predetermined value. Desirably said cushion relief valve is set to open at the supply pressure for the pneumatic actuator.

BRIEF DESCRIPTION OF THE DRAWING

There now follows a description of several alternative pneumatic actuators embodying the invention, by way of example only, with reference to the accompanying diagrammatic drawings, in which.

DETAILED DESCRIPTION OF THE PRESENT INVENTION

Figure 5:
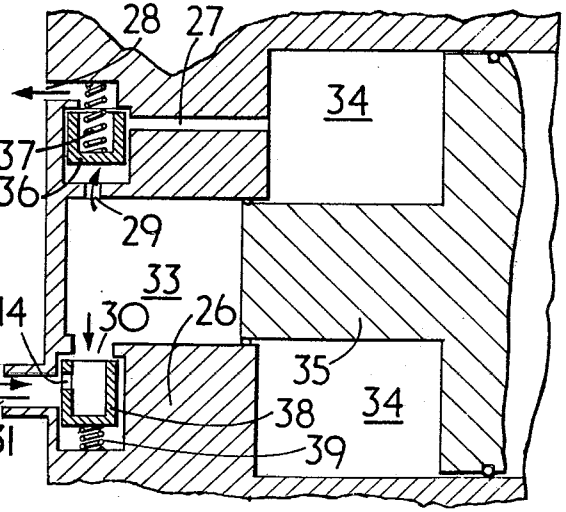
FIG. 5 shows part of one form of pneumatic actuator embodying the invention and incorporating a velocity transducer arranged to provide automatic cushioning of piston velocity.
Figure 6:
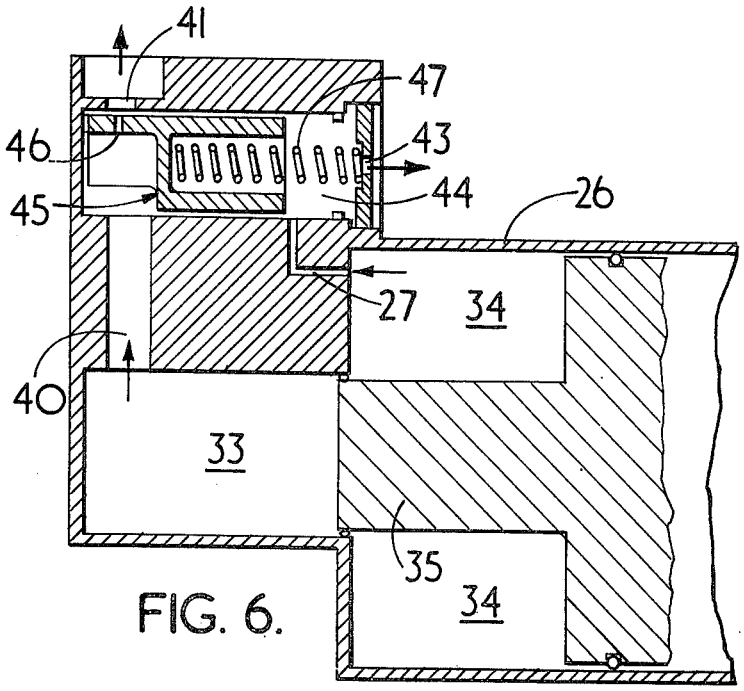
FIG. 6 shows a modification of the pneumatic actuator shown in FIG. 5.
Figure 7:
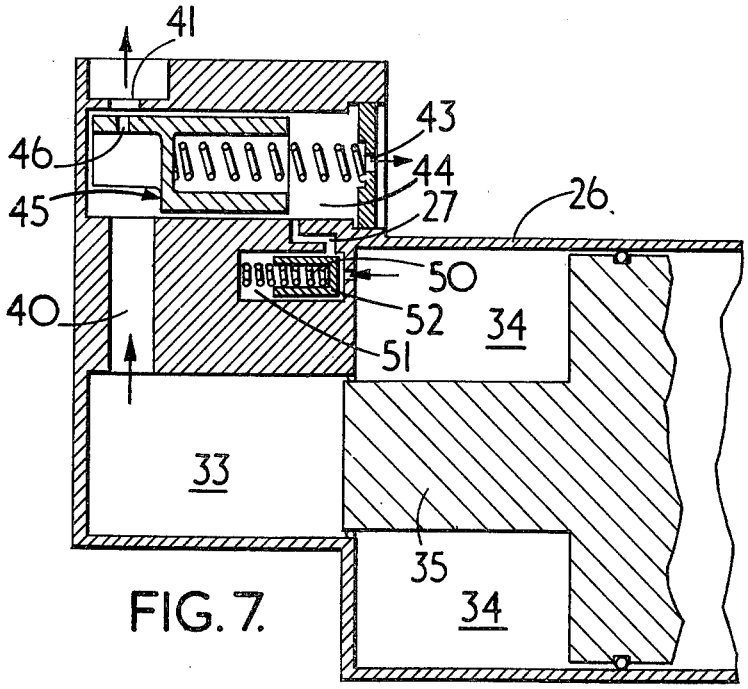
FIG. 7 shows a modification of the pneumatic actuator shown in FIG. 6.

In FIGS. 5 to 7 of the drawings only sufficient portion of the pneumatic actuator has been shown to give a clear understanding of the invention, the remainder of the pneumatic actuator being of any suitable known form.

Figure 1:
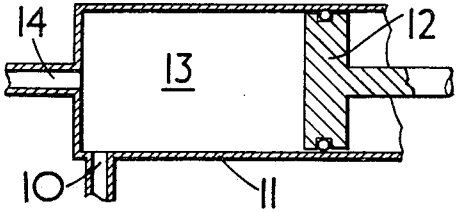
FIG. 1 shows a simple pneumatic velocity transducer for a pneumatic actuator.

Referring to FIG. 1, a basic pneumatic velocity transducer comprises a cylinder 11 within which is slidably fitted a piston 12. The cylinder 11 is provided with an outlet orifice 14 of such cross-sectional size that the pressure P within the working volume 13 of the cylinder is an analogue of the piston velocity. An outlet port 10 is also provided for connecting the pressure P to a suitable controller (not shown in FIGS. 1, 2 and 3). In practice, the piston 12 of the pneumatic velocity transducer is coupled to the output member of a pneumatic actuator. The latter will usually take the form of a piston-in-cylinder device, in which case the pistons of the actuator and transducer can be directly interconnected in the manner illustrated in FIG. 4. Here, the pressure analogue P of the piston velocity available at the outlet port 10 is fed as an input to a controller 25 which in turn controls the supply of air to the working volume of a piston-in-cylinder type of pneumatic actuator. The piston 19 of the pneumatic actuator is coupled through a bridge-piece 21 to the piston 12 of the velocity transducer which consequently monitors the velocity of the piston 19. The controller 25 may be of a suitable known construction and will not be described further.

In practice, a pressure change in the velocity transducer due to a velocity change will not occur instantaneously, the resulting lag in response being referred to as the transducer response time. In order to reduce this response time and thereby achieve more effective monitoring of velocity, it is necessary to to take into account the cross-sectional size of the outlet orifice 14, the instantaneous working volume 13 and the magnitude of change in piston velocity. Once the maximum transducer volume and the outlet orifice cross-sectional size have been determined by design considerations, the only remaining variable is the range of velocities employed. Thus the lowest possible response time may be achieved by reducing to a minimum the range of velocities to be sampled.

Figure 2:
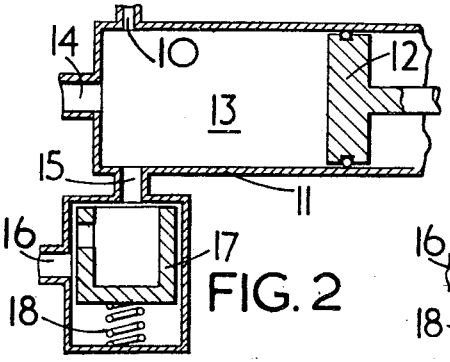
FIG. 2 shows the pneumatic velocity transducer of FIG. 1 modified for operation only below a predetermined maximum velocity.

The basic velocity transducer of FIG. 1 may be adapted to provide a velocity analogue signal only below a predetermined maximum velocity. FIG. 2 shows how this may be achieved by incorporating a simple pressure relief valve which is connected to the working volume 13 of the transducer through a valve port 15. The pressure relief valve includes a piston 17 which is biased by a spring 18 into a position such that the valve port 15 is disconnected from an exhaust port 16. When the velocity of the piston 12 exceeds a predetermined value, the pressure P within the working volume 13, and available as an input to a suitable controller from the outlet port 10, is such that the spring 18 is compressed and the pressure relief valve opens to discharge air from the working volume 13 through the port 16. When the velocity of the piston 12 falls back to the predetermined maximum velocity or below, the pressure relief valve closes and the pressure P in the working volume 13 of the cylinder 11 again becomes a predetermined function of the piston velocity. The orifice 14 may be incorporated in the relief valve itself in which case the valve is effectively always open, but the size of the outlet from the cylinder 11 is effectively varied from a minimum when the piston velocity is at or below a predetermined maximum to a maximum when the piston velocity exceeds the predetermined maximum.

Figure 3:
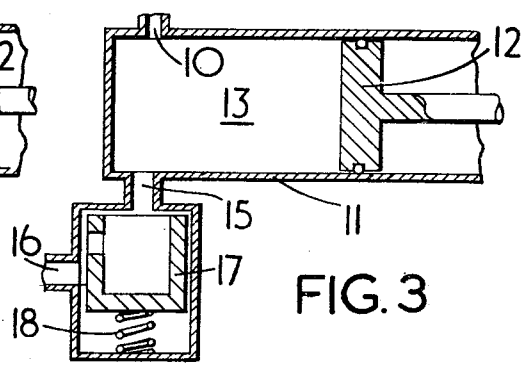
FIG. 3 shows the pneumatic velocity transducer of FIG. 1 modified to operate only above a predetermined velocity.
Figure 4:
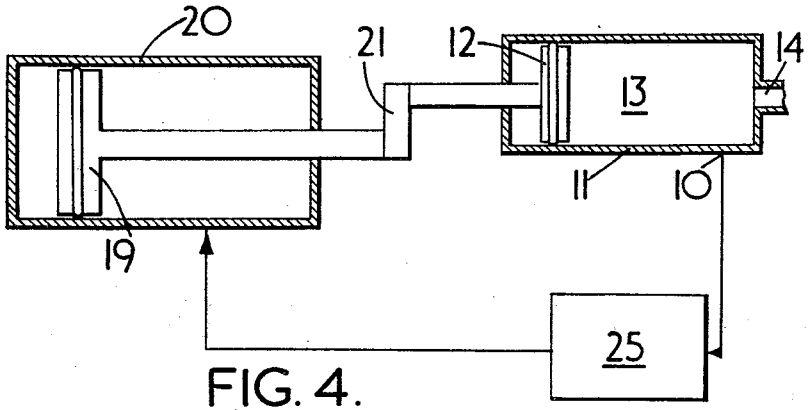
FIG. 4 shows a schematic arrangement illustrating the principle employed in the invention of coupling a velocity transducer directly to a pneumatic actuator to achieve a closed loop control.

FIG. 3 shows a pneumatic velocity transducer adapted to generate a pressure analogue of velocity only for velocities at or above a predetermined minimum velocity. Below this minimum velocity a pressure relief valve, similar to that employed in the pneumatic velocity transducer described with reference to FIG. 2, is not fully open and thus the pressure in the working volume 13 is maintained approximately constant. At velocities equal to and above the predetermined minimum velocity, the pressure relief valve is fully open and the cylinder 11 has an outlet of fixed area whereby the pressure P in the working volume 13, and available at the port 10 as an input to a suitable controller, is a predetermined function of the piston velocity.

FIG. 5 illustrates how the pneumatic velocity transducer described with reference to FIG. 2 may be incorporated in a practical pneumatic actuator device to provide an automatic cushioning action for a common actuator and transducer piston.

Essentially, the object of the cushioning action is to prevent the piston of the pneumatic actuator reaching an extremity of its range of possible movement at a velocity greater than a predetermined maximum value, which would otherwise result in unacceptable high decelerations of the piston and any member connected thereto.

Referring to FIG. 5, the velocity transducer section of a pneumatic actuator comprises a stepped piston 35 with a boss which is locatable within a region of a cylinder 26 of reduced cross-section when the piston is at or near one extremity of its movement. If, at this extremity of its movement, the piston has a velocity which exceeds a predetermined maximum velocity, then the pressure which builds up in a working volume 33 defined between the crown of the piston boss and the walls of the region of reduced cross-section in the cylinder 26 is sufficient to open a pressure relief valve including a spring-loaded piston 38 which communicates with the working volume 33 through a port 30. Thus air in the working volume 33 is exhausted through a comparatively large port 30, through an orifice 14 in the piston 38 to a combined inlet and exhaust port 31. The orifice 14 in the piston 38 is equivalent to the outlet orifice 14 employed in the arrangements described with reference to FIGS. 1, 2, 3 and 4. The pressure of air in the working volume 33 is also communicated through an orifice 29 to an exhaust valve 36 which is biased by a spring 37 into an open position such as to open a passage 27 communicating with another working volume 34 of the cylinder 26. In the closed position of this exhaust valve, as shown in FIG. 5, the piston 36 obstructs the passage 27 and consequently, no air can be expelled from the working volume 34 and the resulting compression serves to slow down the piston. Thus the volume 34 acts as a cushion volume. When the piston velocity drops to an acceptable predetermined level, the pressure developed in the working volume 33 is no longer sufficient to overcome the bias on a spring 39 operating on the piston 38 of the pressure relief valve and the effective orifice cross-sectional area is at a minimum. In this condition of the pressure relief valve, a sufficient amount of air may be displaced form the working volume 33 to allow a piston velocity of, say, three inches per second. When the velocity of the piston falls to, say, 2.5 inches per second, the exhaust valve is arranged to open. The exhaust valve opens because the pressure developed in the working volume 33 is insufficient to overcome the force of the spring 37 on the piston 36 of the exhaust valve and thus the piston 36 moves into a position where the passage 27 is no longer obstructed and air is displaced from the cushion volume 34 through an exhaust port 28. The dimensions of the passage 27 are such as to allow the piston to move at or below the predetermined maximum velocity, a typical value being, for example, two inches per second.

The arrangement described with reference to FIG. 5 may be modified to produce a more compact arrangement illustrated in FIG. 6. Referring to FIG. 6, a single valve, combining the functions of the two valves employed in the arrangement of FIG. 5, is employed in a housing integral with the cylinder 26. This single valve comprises a piston 45 slidably fitted within a chamber 44 and biased into an extreme left hand position, as seen in FIG. 6, by a coil spring 47. The chamber 44 communicates with the working volume 33 of the cylinder 26 through a port 40 and also with the cushion volume 34 through a passage 27 comprising the cushion exhaust gallery as before.

For simplicity, corresponding parts in the arrangements illustrated in FIGS. 5 and 6 have been accorded identical reference numerals.

The valve chamber 44 also communicates with a port 41 through a discharge orifice 46 in the piston 45 and also with a further exhaust or low pressure supply through a port 43. The discharge orifice 46 is of such a size as to allow a predetermined rate of discharge therethrough and is equivalent to the orifice 14 described previously with reference to FIGS. 1 to 5. The valve chamber 44 is divided into two distinct portions by the piston 45 and the left hand part of the valve assembly controls the exhaust of air from the working volume 33 through the port 40 into the port 41 and the right-hand portion of the valve assembly controls the exhaust of air from the cushion volume 34 through the passage 27 and into the port 43. Thus, in operation, a rapid return movement of the piston 35 will result in a pressure rise in working volume 33 which will be communicated through port 40 to the left of the valve piston 45, which will thereby be subjected to a force tending to move it to the right, as seen in FIG. 6. The right-hand movement of piston 45 obstructs the passage 27 and prevents escape of gas from the cushion volume 34. In consequence, the piston 35 is slowed down considerably and so the pressure in the working volume 33 falls correspondingly. The pressure in working volume 33 is prevented from rising excessively, at any time, by the relief action of the valve piston 45 exposing an appropriate area of port 41. In this way the valve piston 45 can respond rapidly to sudden changes in the velocity of the piston 35. When the pressure in working volume 33 has fallen to a magnitude corresponding to a predetermined velocity of the piston 35, typically 3 ins/sec, the pressure on the left of the valve 45 falls also, with the result that the valve returns to the left until the passage 27 is again uncovered.

In order to inhibit any tendency for the pneumatic actuator described with reference to FIGS. 5 and 6 to produce over-cushioning, as hereinafter explained, a further modification may be incorporated. One such arrangement, being a modification of the arrangement described with reference to FIG. 6, is shown in FIG. 7. Referring to FIG. 7, those parts which correspond to parts already described with reference to FIGS. 5 and 6 are given identical reference numerals. The arrangement of FIG. 7 includes an additional cushion relief valve in the passage 27. This cushion relief valve includes a piston 52 movable in a chamber 51 and biased into a position towards the right as seen in FIG. 7 by a coil spring 50. In this extreme right-hand position of the piston 52 the passage 27 is effectively sealed from the cushion volume 34 until the pressure therein exceeds a predetermined level. At all pressures greater than this predetermined level the cushion volume 34 is in free communication with the passage 27 and air is allowed to pass therefrom. The predetermined pressure level is typically the supply pressure for the pneumatic actuator. The use of the cushion relief valve described above prevents over-cushioning which may tend to occur in certain circumstances with the arrangements described with reference to FIGS. 5 and 6. In this over-cushioning condition the pressure in the cushion volume 34 could rise to a value sufficient to cause reversal of the direction of piston movement. During this reversal, air continues to escape along the passage 27 until the pressure in the cushion volume 34 reaches a value just below the supply pressure, sufficient to allow piston acceleration in a direction to the left as seen in FIG. 7 under the influence of the supply pressure acting on the other side of the piston. Consequently there is a tendency for the piston velocity to fall in an oscillatory manner and the cushion relief valve acts to dampen this oscillatory motion. The action of the cushion relief valve in preventing the pressure in the cushion volume 34 from falling below the supply pressure regardless of whether or not the passage 27 is uncovered by the piston 45, serves to prevent piston acceleration to the left as seen in FIG. 7. At the same time excessively high pressures in the cushion volume 34 are rapidly relieved by the opening of the cushion relief valve and the consequent exhaust of air through the passage 27. The latter is of larger cross-section than that in the arrangement described with reference to FIGS. 5 and 6 and essentially is more in the nature of a 'dump orifice' than a piston velocity limiter. When the pressure inside the cushion volume falls below the predetermined value, for example the supply pressure, further discharge from the cushion volume 34 is prevented by the closure of the cushion relief valve and therefore re-acceleration cannot occur.

What I claim as my invention and desire to secure by Letters Patent of the United States is:

1. An actuator comprising a cylinder and a piston within said cylinder, a wall of said cylinder being stepped to define a region of reduced cross-section at one end of the cylinder, said piston also being stepped to define a boss provided at one end adjacent said region of reduced cross-section to be disposed within said region at one extremity of its range of possible movement within the cylinder, a first working chamber defined in said cylinder in said region, an inlet and exhaust passage in said chamber, an orifice in said passage and in communication with said first working chamber, and a pressure relief valve mounted in said passage and operable to control the size of said orifice so that upon a predetermined pressure being produced in said first working chamber said orifice has a fixed cross-sectional orifice exhausting said first working chamber whereby upon said predetermined pressure being produced the pressure in said first working chamber is dependant upon the velocity of said piston in said first working chamber, a second working chamber defined in said cylinder and separated and sealed from said first working chamber by said piston boss when said boss is located in said region to act as a cushion volume to limit the piston velocity, an exhaust passage in communication with said second working chamber, an exhaust valve in said exhaust passage, biasing means biasing said exhaust valve towards an open position, an outlet orifice in said exhaust passage closable by the exhaust valve, and a connecting passage communicating pressure from said first working chamber to said exhaust valve to operate said valve against the action of said biasing means and close said outlet orifice upon a predetermined pressure being produced in said first working chamber.

2. An actuator comprising a cylinder and a piston within said cylinder, said piston and said cylinder being stepped to define a piston boss and a cylinder region of reduced cross-section to divide said cylinder into first and second working chambers when said stepped portions are engaged, said chambers being fluidly separated from one another when the piston is near one extremity of its range of possible movement in the cylinder, the first working chamber having a first inlet and exhaust passage with an orifice for exhausting from the first chamber and a presssure responsive inlet and exhaust valve means in said first passage whereby the pressure in the first chamber is dependent on the velocity of said piston in the first working chamber, the second working chamber having a second exhaust passage, valve means in said second passage communicating with the first chamber by a connecting passage to actuate the valve means by the pressure in the first chamber, and a second outlet orifice which is closed by the valve means actuated by pressure from the first chamber to prevent the second chamber from exhausting if the pressure in the first chamber exceeds a predetermined value, the second working chamber thereby functioning as a cushion for said piston when said piston moves at a predetermined velocity.

3. An actuator comprising a cylinder and a piston within said cylinder said piston being stepped to form a boss and cooperating with a reduced diameter portion of said cylinder to divide said cylinder into a first working chamber and a second working chamber when said boss and reduced diameter portion are engaged, said first and second chambers being fluidly separated from each other when the piston is near one extremity of its range of possible movement in the cylinder, a first inlet and exhaust passage with a first orifice for exhausting fluid from said first chamber, a pressure responsive inlet and exhaust valve in said first passage including an orifice therethrough, a second exhaust passage with a second outlet orifice for exhausting fluid from said second chamber, and valve means movable between a first and second position disposed in said second exhaust passage, said valve means including biasing means to bias said valve towards said first position which first position permits unobstructed fluid flow through said second exhaust passage, said valve means includes means for fluid communication with said first chamber so that said valve means moves to said second position when the fluid pressure in said first chamber exceeds a predetermined value, said second position of said valve means being operable to obstruct said second exhaust passage so that the second working chamber functions as a cushion for said piston when the pressure in said first chamber exceeds a predetermined value.

* * * * *